US005423925A

United States Patent [19]

Shoji et al.

[11] Patent Number: 5,423,925

[45] Date of Patent: Jun. 13, 1995

[54] PROCESS FOR MANUFACTURING AL-MG ALLOY SHEETS FOR PRESS FORMING

[75] Inventors: Ryo Shoji; Yoichiro Bekki, both of Tokyo, Japan

[73] Assignee: The Furukawa Electric Co., Ltd., Tokyo, Japan

[21] Appl. No.: 142,740

[22] Filed: Oct. 25, 1993

[30] Foreign Application Priority Data

Oct. 23, 1993 [JP] Japan ..... 4-309645
Oct. 23, 1993 [JP] Japan ..... 4-309646

[51] Int. Cl.[6] ..... C21D 9/46
[52] U.S. Cl. ..... 148/692; 148/552
[58] Field of Search ..... 148/552, 692

[56] References Cited

U.S. PATENT DOCUMENTS 4,140,556 2/1979 Baba et al. ..... 148/552
4,897,124 1/1990 Matsuo et al. ..... 148/552

FOREIGN PATENT DOCUMENTS 58-171547 10/1983 Japan ..... 148/692
2008353 1/1990 Japan ..... 148/692
2194152 7/1990 Japan ..... 148/552

*Primary Examiner*—George Wyszsmierski
*Assistant Examiner*—Margery S. Phipps
*Attorney, Agent, or Firm*—Vineet Kohli; Thomas R. Morrison

[57] ABSTRACT

A process for producing high Mg content Al-Mg alloy sheet for press forming having a high tensile strength and formability. The maximum grain diameter of the alloy slab is less than 1000 μm. The process consists of the steps of forming the slab, homogenizing, hot rolling, cold rolling and annealing. The composition of the alloy is disclosed as having the elements of Al, Mg, Be, B, Cu, Ti, Si as major components, the balance being inevitable impurities.

10 Claims, No Drawings

PROCESS FOR MANUFACTURING AL-MG ALLOY SHEETS FOR PRESS FORMING

BACKGROUND OF THE INVENTION

The present invention relates to a process for manufacturing Al-Mg alloy sheets. More particularly, the present invention is directed to a process for manufacturing Al-Mg alloy sheets suitable for press forming auto body panels, air cleaners, oil tanks and similar products which require superior strength and high formability.

The present invention is also directed to high Mg content Al-Mg alloy sheets which are superior in strength and formability.

One example of prior art uses cold rolled steel sheets for press forming auto body panels and similar products. In recent years, a demand for lighter auto body panels has become popular. Customer demands for lighter automobiles with increased fuel consumption has created a need for lighter auto body panels.

Therefore, it is desirable that the prior art cold rolled steel sheets be replaced with light weight Al-Mg alloy sheets with superior strength and high formability. It is thought that the use of a high Mg content Al-Mg alloy sheet will not only reduce the overall weight of auto body panels, but also contribute to improved fuel consumption.

Prior art aluminum alloy sheets for press forming which exhibit strength and formability, include O stock Al-Mg alloy 5052 which consists essentially of a chromium alloy containing 2.5 wt. % of Al and 0.25 wt. % of Mg. Another example of a prior art aluminum alloy sheet is an O stock Al-Mg alloy 5182 which consists essentially of a manganese alloy containing 4.5 wt. % of Al and 0.35 wt. % of Mg. Further examples include a T4 stock of Al-Cu alloy 2036 consisting essentially of a magnesium alloy containing 2.6 wt. % of Al, 0.25 wt. % of Cu and 0.45 wt. % of Mn.

Of these prior art aluminum alloy sheets, only the Al-Mg alloy sheets exhibit superior formability and strength. Such prior art aluminum sheets are often used due to their capability to adhere to the strict press forming conditions.

Prior art Al-Mg alloy sheets for press forming are usually manufactured by a process which includes forming slabs for rolling, homogenization the slab, followed by hot rolling the homogenized slab, cold rolling and final annealing.

Additionally, an intermediate annealing step may be included prior to the cold rolling step. In situations requiring flat sheets, a straightening step is often carried out by one of a tension leveler, a roller leveler and skin pass rolling after the annealing step.

Conventional Al-Mg alloy sheets for press forming manufactured by such prior art methods are relatively abundant in ductility when compared to other aluminum alloy sheets.

However, the elongation of prior art Al-Mg alloy sheet is approximately 30% at most, whereas the elongation of a cold rolled steel sheet is 40%. Therefore, particularly with respect to the formability, where the elongation is an influencing factor in stretch forming, bending and flanging, the prior art Al-Mg alloy sheet is inferior to the cold rolled steel sheet.

Elongation of Al-Mg alloy sheets can substantially be improved in proportion to the Mg content therein. In order to overcome the above mentioned drawback, prior art methods for producing Al-Mg alloy sheets with improved elongation have attempted to provide a method in which the Mg content is substantially increased.

In one prior art example, the Mg content ranges from 2.5% to about 5.0 wt % which allegedly improves the elongation of the Al-Mg sheets.

In another example of the prior art, a method for producing improved Al-Mg alloy sheets is disclosed, wherein elongation is substantially increased to about 35% when the Mg content is substantially equal to 6 wt. %.

Japanese Laid Open Patent Publication No. 4-102456 attempts to improve elongation by disclosing an Al-Mg alloy sheet with a Mg content of 8%. The presence of this amount of Mg is believed to improve the elongation to about 40%.

One drawback to prior art methods of producing high content Al-Mg alloy sheets on an industrial scale is the appearance of cracks in the alloy material. It has been observed that cracks are often generated during the step of hot rolling. This feature, in turn, makes it difficult to perform subsequent hot rolling of the prior art alloy slabs.

The gist of the drawbacks associated with producing high content Mg Al-Mg alloy sheets is that continuous hot rolling produces cracks, which substantially lowers the yield of the high Mg content Al-Mg alloy sheets and is not cost effective.

In order to substantially improve the output of high content Mg Al-Mg alloy sheets and lower the cost associated with its production, it is necessary to remove the cracked portions as they are generated.

The present invention has been devised to solve the aforementioned problems.

OBJECTS AND SUMMARY OF THE INVENTION

It is an object of the present invention to provide a process for manufacturing Al-Mg alloy sheets for press forming, which can improve the hot workability of such Al-Mg alloy sheets with high Mg content as to contain not less than 5 wt. % of Mg, and can improve the productivity by preventing the generation of cracks during hot rolling.

It is still a further object of the present invention to provide a high Mg content Al-Mg alloy sheet with superior strength and formability.

Briefly stated, a process for producing high Mg content Al-Mg alloy sheet for press forming having a high tensile strength and formability. The maximum grain diameter of the alloy slab is less than 1000 μm. The process consists of the steps of forming the slab, homogenizing, hot rolling, cold rolling and annealing. The composition of the alloy is disclosed as having the elements of Al, Mg, Be, B, Cu, Ti, Si as major components, the balance being inevitable impurities.

According to a feature of the present invention, there is provided a process for manufacturing Al-Mg alloy sheets for press forming which includes preparing an Al-Mg based alloy slab; homogenizing the slab at a homogenizing temperature of from 450° to 540° C. for no more than 24 hours in order to maintain an average grain diameter of less than 1000 μm; hot rolling the homogenized slab at a hot mill entrance temperature; cold rolling the slab and annealing the slab; the step of cold rolling and the step of annealing being interchangeable in order.

Additionally, the Al-Mg alloy slab contains by weight, from about 5 to about 10% Mg, of from about 0.0001 to about 0.01% Be, of from about 0.01 to about 0.2% of at least one of Mn, Cr, V and Zr, of from of said Al-Mg based alloy; of from about 0.005 to about 0.1% Ti, of from about 0.00001 to about 0.05% B, with the balance substantially Al and inevitable impurities such as Fe and Si being less than 0.2% and Zn less than 0.3%.

According to another feature of the present invention, there is provided a high Mg content Al-Mg alloy sheets which includes by weight of from about 5 to about 10% Mg, of from about 0.001 to about 0.01% Be, of from about 0.01 to about 0.2% of at least one of Mn, Cr, V and Zr, of from of said Al-Mg based alloy; of from about 0.005 to about 0.1% Ti, of from about 0.00001 to about 0.05% B, with the balance substantially Al and inevitable impurities such as Fe and Si being less than 0.2% and Zn less than 0.3%. Additionally, the high Mg content Al-Mg alloy sheets are started from an Al-Mg alloy slab having an average grain diameter of less than 1000 μm.

In one embodiment of the present invention, the Al-Mg alloy sheets include by weight Cu which is added to the Al-based alloy as a sixth element, being from about 0.05 to about 0.8%.

The above, and other objects, features and advantages of the present invention will become apparent from the following description.

DETAILED DESCRIPTION OF THE PREFERRED EMBODIMENTS

A process for manufacturing Al-Mg alloy sheets for press forming of the present invention includes providing an Al-Mg alloy slab, homogenizing the alloy slab, followed by hot rolling, cold rolling and final annealing the Al-Mg alloy slab to provide a high Mg content Al-Mg alloy sheets, wherein the composition of the Al-Mg alloy slab contains from about 5 to 10 percent by weight of Mg, from about 0.0001 to about 0.01 percent by weight Be, 0.01 to 0.2 percent by weight of at least one of Mn, Cr, Zr and V, 0.005 to about 0.1 percent by weight of Ti, and from about 0.00001 to about 0.05 percent by weight B, Fe and Si as impurities respectively, wherein at least one of Fe and Si is present at a concentration not exceeding 0.2 percent by weight and the remainder consisting of other inevitable impurities and Al. Copper is added as an additional element in an amount, by weight, ranging from 0.5 to 0.8% of the total alloy composition.

Additionally, the maximum grain diameter of the high Mg content Al-Mg alloy slab is less than 1000 μm; the homogenization temperature of the high Mg content Al-Mg alloy slab ranges from about 450° to 540° C. and the time for homogenization is not more than 24 hours.

Hot rolling includes rolling the homogenized Al-Mg alloy slab under conditions wherein the hot mill entrance temperature ranges from 320° to about 470° C. and each reduction per pass of at least the initial three times of rolling pass is not more than 3%.

The addition of Cu to the high Mg content Al-Mg alloy slab during the process of manufacturing high Mg content Al-Mg alloy sheets substantially improves the strength and elongation of the Al-Mg alloy sheets.

It is preferred that the Cu content range from about 0.05 to about 0.8 wt. %.

Mg is added to provide the strength and elongation to the resultant aluminum alloy sheet. A Mg content of less than 5 wt. %, effects the elongation of the alloy sheets. Specifically, when the Mg content is less than 5 wt. %, the elongation of the sheet is less than 30%. On the other hand, when the Mg content exceeds 10 wt. %, the hot workability of the alloy slab is rapidly lowered. This feature in turn, makes it substantially difficult to manufacture the alloy sheet.

Be is added to prevent oxidation of the molten metal at the time of melting and casting of the alloy. Be also prevents loss of Mg and superficial change of color which usually results from oxidation of the slab during homogenization.

When the Be content is less than 0.0001 wt. %, Be is unable to effectively prevent oxidation of the molten metal. On the other hand, a Be content of more than 0.01 wt. %, results in toxicity which substantially impairs the manufacturing process.

Mn, Cr, V and Zr are added in order to improve the hot workability of the alloy.

However, high Mg content Al-Mg alloy sheets produced by conventional methods exhibit poor hot-workability. It is thought that homogenization generates coarse grains which impart poor hot-workability to the resultant high Mg content Al-Mg alloy sheets. Essentially, when the average grain size exceeds 1000 μm, the hot workability of the Al-Mg alloy sheets is greatly reduced.

In an effort to overcome this deficiency, the present inventors have discovered that the addition of Mn, Cr, V and Zr, during homogenization of the Al-Mg alloy slab, substantially reduces generation of huge coarse grains, which improves the hot workability of the high Mg content Al-Mg alloy sheets.

Briefly, upon addition of Mn, Cr, V and Zr, these elements precipitate into the aluminum matrix as extremely fine precipitates in the temperature-up process used during homogenization of the alloy slab.

In turn, these extremely fine precipitates control the growth of the coarse grains (secondary recrystallized grains) under homogenization.

0.01 to 0.2 wt. % of at least one of Mn, Cr, V and Zr need be added in order to regulate the generation of the coarse grains. When the content of Mn, Cr, V and Zr is less than 0.01 wt. % their effect in regulating the grain size is insignificant. On the other hand, when the content exceeds 0.2 wt. %, coarse intermetallic compounds are formed which in turn, substantially reduce the elongation of the alloy sheets.

In an attempt to maintain the maximum grain diameter under 1000 μm, during the step of homogenization, Ti or a mixture of Ti and B are usually added to the homogenized alloy slab.

It is worth noting, that when Ti is present in an amount less than 0.005 wt. %, Ti is unable to effectively control the maximum grain diameter. On the other hand, when the Ti content exceeds 0.1 wt. %, coarse intermetallic compounds are formed which substantially lower the elongation of the alloy sheets.

B coexists with Ti to further enhance the fine slab structure. It is preferable to add from about 0.00001 to 0.05 wt. % of B. When B is present at less than 0.00001 wt. %, its effect on the fine structure of the slab is negligible. On the other hand, when the B content exceeds 0.05 wt. %, coarse $TiB_2$ compounds are formed which also lower the elongation of the alloy sheets.

Fe and Si are inherent impurities of the Al-Mg alloy. It is preferred that the concentration of these two impurities be regulated so as not to exceed 0.2 wt. %.

If the Fe and Si are present in an amount exceeding 0.2 wt. %, they are continuously crystallized out of solution in a grain boundary as eutectic constituents at the time of casting, and grain boundary strength in hot rolling is lowered causing cracks in the alloy sheet. In addition, both elongation and formability of the finally annealed sheet is lowered.

In order to further improve the strength and elongation of the alloy sheet, Cu should be added ranging from about 0.05 to 0.8 wt. %.

A Cu content of less than 0.05 wt. %, does not have any effect on the elongation and strength of the alloy sheets. By contrast, when the Cu content exceeds 0.8 wt. %, the hot workability of the alloy is rapidly lowered and it becomes difficult to manufacture the alloy sheet.

It is preferable that the total content of Zn and other inevitable impurities not exceed 0.3 wt. %.

Each aluminum alloy slab having the above-mentioned composition and a maximum grain diameter less than 1000 μm is homogenized at a homogeniszing temperature of from 450° to about 540° C. for a period of time, not exceeding 24 hours, which prevents the maximum grain diameter from exceeding 1000 μm.

When the maximum grain diameter of the alloy slab substantially exceeds 1000 μm, the resultant stress concentration on the grain boundary causes the grain boundary to break while the slab is undergoing hot rolling. This, in turn, produces cracks which make the process of manufacturing the alloy sheets substantially difficult.

It is thought, that a slab with fine grains improves the hot workability property of the resulting alloy sheets. In keeping with this observation, it is preferred that the maximum grain diameter of the grains be about 200 μm or less.

Homogenization is carried out in order to homogenize the distribution of the solute atoms of the slabs and the annealed alloy sheet structure. Homogenization also improves the strength and elongation of the alloy sheets for press forming.

A homogenization temperature of less 450° C. does not effectively homogenize the sheet structure. By contrast, a homogenization temperature of more than 540° C. results in coarser grains (i.e., secondary recrystallized grains), and the maximum grain diameter exceeds 1000 m. This lowers the hot workability of the alloy sheets. A similar effect is seen when the structure is homogenized for more than 24 hours.

In cases where the starting slab structure is coarse before homogenization, that is, after casting, the grains can not be made fine, even by means of further homogenization. Therefore, it is necessary to provide a slab with a fine structure. This can be achieved by the addition of Ti or Ti and B, prior to homogenizing the slab.

As described above, the homogenized aluminum alloy slab having the maximum grain diameter of less than 1000 μm is subsequently subjected to hot rolling.

In industrial hot rolling, the homogenized alloy slab, having a thickness of 300 to 700 mm, is normally processed into a hot rolled sheet ranging in thickness of from 2 to about 10 mm. This is achieved by subjecting the alloy slabs to a repetitive rolling pass.

In hot rolling a high Mg content Al-Mg alloy, cracks due to hot rolling are usually generated either during the first or during any of the subsequent second to fifth rolling pass.

It is worth noting, that a minor crack appearing during the initial hot rolling pass has a tendency to expand and become larger during the subsequent rolling pass treatment. This crack often develops into a large crack during the latter-half rolling pass or the final rolling pass.

It is possible to entirely eliminate the appearance of such cracks due to hot rolling in an industrial setting, by setting the hot mill entrance temperature to be in the range of from 320° to about 470° C. The elimination of cracks during hot rolling can be further aided by setting each reduction per pass of at least the initial three times of rolling pass to be not more than 3%.

When the hot mill entrance temperature for hot rolling is less than 320° C., the deforming resistance of the alloy slab becomes large enough to require an increase in the load required for rolling. This feature makes industrial rolling difficult.

On the other hand, when the hot mill entrance temperature exceeds 470° C., the generation of cracks due to rolling are substantially increased.

The reason why each reduction per pass of at least the initial three times of rolling pass is set to be not more than 3% is that the cracks due to hot rolling are prevented by applying a reduction as low as possible at the initial rolling pass which would easily generate the cracks due to hot rolling.

When each reduction per pass at the initial three times of rolling pass exceeds 3%, an excessive stress is applied to the grain boundary at the time of rolling which is in excess of the grain strength. This excessive stress causes the grain boundary to break resulting in the generation of cracks due to hot rolling.

Even assuming that such a hot rolling process can be adopted, the cracks due to hot rolling will continue to appear when the maximum grain diameter of the homogenized alloy slab exceeds 1000 μm.

There is no need to set each reduction per pass to be less than 3% after the lapse of the initial three times of rolling pass (on and after the fourth rolling pass). Thus, each reduction per pass may be increased so as to improve the productivity.

The alloy sheet subjected to hot rolling under the rolling conditions described above is subsequently subjected to cold rolling or intermediate annealing (during) on the way of the cold rolling, in order to produce a desired thickness. Then, the resultant sheet is subjected to final annealing to provide an Al-Mg alloy sheet for press forming and having a thickness of approximately of from 0.8 to about 2.0 mm.

The Al-Mg alloy sheet thus obtained exhibits superior strength and elongation when compared to prior art Al-Mg alloy sheets manufactured by conventional processes.

The present invention is described in detail below with reference to examples.

EXAMPLE 1

In this example, Al-Mg alloy sheets for press forming were manufactured as follows: initially, aluminum alloys having compositions similar to alloy samples nos. 1 to 22 shown in Tables 1 and 2 were subjected to DC casting (thickness: 500 mm, width: 1500 mm and length: 5000 mm) by a normal process. Then, each of the resultant alloy slabs was homogenized at 490° C. for 1 hr., and then subjected to hot rolling up to 5 mm in thickness under the following conditions.

In each of the alloy samples given in Table 1, the presence of Cu in an amount less than 0.05 wt. % was considered an impurity.

Hot mill entrance temperature: 440° C.

Reduction per pass at the initial three times of rolling pass: 1.5%

Reduction per pass from the 4th to 20th rolling pass: 3 to 4%

Reduction per pass on and after the 21st rolling pass: 5 to 40%

Total pass times: 32 times

With respect to the slab of each alloy sample listed in Tables 1 and 2, the grain diameter before and after homogenization was recorded, and the hot workability was compared with one another. The results thus obtained are shown in Tables 3 and 4.

Furthermore, each alloy sheet subjected to hot rolling as described above, was subjected to cold rolling up to 1 mm in thickness, and then annealed at 500° C. for 10 sec. in a continuous annealing line to manufacture O stocks, which were then respectively applied to a tension test for measuring the mechanical properties. The results thus obtained are shown in Tables 5 and 6.

It seems clear from the data in Tables 3 and 4, that all the slabs of alloy samples nos. 1 to 5, and 12 to 16 having the compositions according to the example of the invention showed superior hot workability.

With respect to the alloys of alloy samples nos. 5 and 16, some fine cracks were generated. However, since the extent of such fine cracks was slight, their appearance did not impair the industrial manufacture of the alloy sheets.

Further, it seems clear from Tables 5 and 6, the rolled sheets manufactured from the alloy slabs of alloy samples nos. 1 to 5 and 12 to 16 are excellent in both strength and elongation.

On the other hand, alloy slabs of alloy samples nos. 6 to 9 containing a small content of Ti or both Ti and B, or with a small content of Mn, Cr, Zr and V, and a maximum grain diameter after homogenization exceeding 1000 μm generated some cracks at the beginning of hot rolling. Consequently, the steps of subsequent hot rolling were not performed.

With respect to the alloys of alloy samples nos. 17 and 18, which had a large Mg or Cu content, and the alloys of alloy samples No. 21 which had a large total content of Fe and Si, cracks were generated during hot rolling, which in turn, prevented subsequent hot rolling steps from being performed.

With respect to alloy slabs similar to alloy samples nos. 10, 11, 19 and 20 having a large content of either Fe and Si, the subsequent hot rolling was possible even though cracks were generated during rolling. However, the rolled sheets manufactured from these alloys were low in elongation. The elongation of each sheet was less than 30%.

With respect to the alloy of alloy sample no. 22 having a small content of Mg, there was no problem with respect to hot workability. However, the rolled sheet manufactured from this alloy was inferior in both strength and elongation.

TABLE 1

| Alloy Sample No. | Classification | Alloy Compositions (Wt. %) | | | | | | | | | | | |
|---|---|---|---|---|---|---|---|---|---|---|---|---|---|
| | | Mg | Cu | Be | Mn | Cr | Zr | V | Ti | B | Si | Fe | Al |
| 1 | Example of the Invention | 5.4 | 0.02 | 0.0006 | 0.03 | — | — | 0.01 | 0.01 | 0.0005 | 0.04 | 0.05 | Remainders |
| 2 | Example of the Invention | 6.5 | 0.12 | 0.0014 | — | 0.04 | — | 0.02 | 0.01 | — | 0.05 | 0.08 | Remainders |
| 3 | Example of the Invention | 7.8 | — | 0.0025 | 0.01 | 0.04 | 0.02 | — | 0.02 | 0.0006 | 0.07 | 0.03 | Remainders |
| 4 | Example of the Invention | 8.2 | 0.02 | 0.0015 | 0.01 | 0.01 | — | 0.02 | 0.01 | 0.0007 | 0.04 | 0.10 | Remainders |
| 5 | Example of the Invention | 9.4 | 0.01 | 0.0020 | — | 0.08 | 0.01 | — | 0.02 | 0.0008 | 0.04 | 0.11 | Remainders |
| 6 | Comparative Example | 7.8 | 0.05 | 0.0012 | — | 0.02 | — | 0.01 | 0.002 | 0.0002 | 0.04 | 0.15 | Remainders |
| 7 | Comparative Example | 8.1 | 0.06 | 0.0015 | 0.01 | 0.01 | 0.02 | — | 0.002 | 0.000005 | 0.06 | 0.12 | Remainders |
| 8 | Comparative Example | 8.5 | 0.08 | 0.0020 | 0.003 | 0.001 | 0.002 | — | 0.01 | 0.0005 | 0.08 | 0.01 | Remainders |
| 9 | Comparative Example | 7.8 | 0.05 | 0.0010 | — | 0.003 | — | 0.002 | 0.01 | 0.0005 | 0.04 | 0.10 | Remainders |
| 10 | Comparative Example | 7.8 | 0.3 | 0.0025 | 0.01 | 0.04 | 0.02 | — | 0.02 | 0.0006 | 0.28 | 0.16 | Remainders |
| 11 | Comparative Example | 8.2 | 0.01 | 0.0015 | 0.01 | 0.01 | — | 0.02 | 0.02 | 0.0007 | 0.17 | 0.35 | Remainders |

TABLE 2

| Alloy Sample No. | Classification | Alloy Compositions (Wt. %) | | | | | | | | | | | |
|---|---|---|---|---|---|---|---|---|---|---|---|---|---|
| | | Mg | Cu | Be | Mn | Cr | Zr | V | Ti | B | Si | Fe | Al |
| 12 | Example of the Invention | 5.4 | 0.42 | 0.0006 | 0.03 | — | — | 0.01 | 0.01 | 0.0005 | 0.04 | 0.05 | Remainders |
| 13 | Example of the Invention | 6.5 | 0.32 | 0.0014 | — | 0.04 | — | 0.02 | 0.01 | — | 0.05 | 0.08 | Remainders |
| 14 | Example of the Invention | 7.8 | 0.25 | 0.0025 | 0.01 | 0.04 | 0.02 | — | 0.02 | 0.0006 | 0.07 | 0.03 | Remainders |
| 15 | Example of the Invention | 8.2 | 0.62 | 0.0015 | 0.01 | 0.01 | — | 0.02 | 0.01 | 0.0007 | 0.04 | 0.10 | Remainders |
| 16 | Example of the Invention | 9.4 | 0.78 | 0.0020 | — | 0.08 | 0.01 | — | 0.02 | 0.0008 | 0.04 | 0.11 | Remainders |
| 17 | Comparative | 12.5 | 0.45 | 0.0010 | 0.02 | 0.02 | 0.01 | 0.02 | 0.01 | 0.0005 | 0.04 | 0.11 | Remain- |

TABLE 2-continued

| Alloy Sample No. | Classification | Alloy Compositions (Wt. %) | | | | | | | | | | | |
|---|---|---|---|---|---|---|---|---|---|---|---|---|---|
| | | Mg | Cu | Be | Mn | Cr | Zr | V | Ti | B | Si | Fe | Al |
| | Example | | | | | | | | | | | | ders |
| 18 | Comparative Example | 8.5 | 1.4 | 0.0010 | 0.01 | 0.02 | — | 0.01 | 0.01 | 0.0005 | 0.05 | 0.10 | Remainders |
| 19 | Comparative Example | 6.5 | 0.25 | 0.0025 | 0.01 | 0.04 | 0.02 | — | 0.02 | 0.0006 | 0.07 | 0.28 | Remainders |
| 20 | Comparative Example | 6.5 | 0.25 | 0.0025 | 0.02 | 0.04 | — | — | 0.02 | 0.0006 | 0.30 | 0.05 | Remainders |
| 21 | Comparative Example | 6.5 | 0.25 | 0.0025 | 0.01 | 0.04 | 0.01 | — | 0.02 | 0.0006 | 0.30 | 0.32 | Remainders |
| 22 | Comparative Example | 4.2 | 0.20 | 0.0025 | 0.02 | 0.04 | 0.02 | — | 0.02 | 0.0006 | 0.07 | 0.09 | Remainders |

TABLE 3

| Alloy Sample No. | Classification | Maximum Grain Diameter (μm) after Casting | Maximum Grain Diameter (μm) after Homogenization | Results of Hot Rolling |
|---|---|---|---|---|
| 1 | Example of the Invention | 170 | 180 | Good and no crack was generated at all. |
| 2 | Example of the Invention | 85 | 95 | Good and no crack was generated at all. |
| 3 | Example of the Invention | 56 | 60 | Good and no crack was generated at all. |
| 4 | Example of the Invention | 105 | 125 | Good and no crack was generated at all. |
| 5 | Example of the Invention | 245 | 290 | No particular problem although fine cracks of about 2 mm in length were generated on both edges. |
| 6 | Comparative Example | 11000 | 11500 | Slab was largely cracked on both edges at the fifth rolling pass and the subsequent rolling was impossible. |
| 7 | Comparative Example | 14000 | 14500 | Slab was largely cracked at the first rolling pass and the subsequent rolling was impossible. |
| 8 | Comparative Example | 20000 | 22500 | Slab was largely cracked at the first rolling pass and the subsequent rolling was impossible. |
| 9 | Comparative Example | 250 | 11000 | Slab was largely cracked at the second rolling pass and the subsequent rolling was impossible. |
| 10 | Comparative Example | 70 | 80 | Cracks of about 30 mm in length were generated on both edges. |
| 11 | Comparative Example | 95 | 108 | Cracks of about 100 mm in length were generated on both edges. |

TABLE 4

| Alloy Sample No. | Classification | Maximum Grain Diameter (μm) after Casting | Maximum Grain Diameter (μm) after Homogenization | Results of Hot Rolling |
|---|---|---|---|---|
| 12 | Example of the Invention | 160 | 170 | Good and no crack was generated at all. |
| 13 | Example of the Invention | 75 | 85 | Good and no crack was generated at all. |
| 14 | Example of the Invention | 46 | 60 | Good and no crack was generated at all. |
| 15 | Example of the Invention | 100 | 115 | Good and no crack was generated at all. |
| 16 | Example of the Invention | 240 | 270 | No particular problem although fine cracks of about 2 mm in length were generated on both edges. |
| 17 | Comparative Example | 140 | 148 | Slab was largely cracked at the first pass and the subsequent rolling was impossible. |
| 18 | Comparative Example | 205 | 215 | Slab was largely cracked at the first pass and the subsequent rolling was impossible. |
| 19 | Comparative Example | 80 | 85 | Cracks of about 50 mm in length were generated on both edges. |
| 20 | Comparative Example | 70 | 72 | Cracks of about 30 mm in length were generated on both edges. |
| 21 | Comparative Example | 70 | 75 | Slab was largely cracked at the tenth rolling pass and the subsequent rolling was impossible. |
| 22 | Comparative Example | 85 | 90 | Good and no crack was generated at all. |

TABLE 5

| Alloy Sample No. | Classification | Tensile Strength (MPa) | Proof Stress (MPa) | Elongation (%) |
|---|---|---|---|---|
| 1 | Example of the Invention | 310 | 125 | 34 |
| 2 | Example of the Invention | 324 | 132 | 37 |
| 3 | Example of the Invention | 348 | 135 | 38 |
| 4 | Example of the Invention | 352 | 140 | 38 |
| 5 | Example of the Invention | 375 | 150 | 39 |
| 6–9 | Comparative Example | The subsequent cold rolling was impossible due to the cracks caused by hot rolling. | | |
| 10 | Comparative Example | 350 | 135 | 28 |
| 11 | Comparative Example | 353 | 142 | 26 |

TABLE 6

| Alloy Sample No. | Classification | Tensile Strength (MPa) | Proof Stress (MPa) | Elongation (%) |
|---|---|---|---|---|
| 12 | Example of the Invention | 345 | 130 | 35 |
| 13 | Example of the Invention | 360 | 135 | 37 |
| 14 | Example of the Invention | 368 | 141 | 39 |
| 15 | Example of the Invention | 381 | 150 | 39 |
| 16 | Example of the Invention | 390 | 162 | 40 |
| 17–18 | Comparative Example | The subsequent cold rolling was impossible due to the cracks caused by hot rolling. | | |
| 19 | Comparative Example | 355 | 145 | 29 |
| 20 | Comparative Example | 348 | 140 | 27 |
| 21 | Comparative Example | The subsequent cold rolling was impossible due to the cracks caused by hot rolling. | | |
| 22 | Comparative Example | 275 | 105 | 24 |

EXAMPLE 2

A DC slab from alloy sample nos. 4 (Table 1) and 15 (Table 2) having the compositions according to example of the invention were homogenized respectively under different conditions. Essentially sample nos. 23 to 27 and sample nos. 33 to 37 were homogenized based on the homogenization conditions in the manufacturing process of the invention, and sample nos. 28 to 32 and sample nos. 38 to 42 were homogenized based on the homogenization conditions other than those of the invention, as shown in sample nos. 23 to 32 in Table 7 and sample nos. 33 to 42 in Table 8.

TABLE 7

| Case No. | Classification | Homogenization Conditions Temp. (°C.) | Homogenization Conditions Time (Hr) | Maximum Grain Diameter (μm) after Homogenization | Results of Hot Rolling |
|---|---|---|---|---|---|
| 23 | Example of the Invention | 480 | 13 | 75 | Good and no crack was generated at all. |
| 24 | Example of the Invention | 490 | 7 | 100 | Good and no crack was generated at all. |
| 25 | Example of the Invention | 500 | 2 | 115 | Good and no crack was generated at all. |
| 26 | Example of the Invention | 510 | 1 | 125 | Good and no crack was generated at all. |
| 27 | Example of the Invention | 530 | 1 | 250 | No particular problem although fine cracks of about 3 mm in length were generated on both edges. |
| 28 | Comparative Example | 540 | 28 | 25000 | Slab was largely cracked at the first rolling pass and the subsequent rolling was impossible. |
| 29 | Comparative Example | 550 | 1 | 13500 | Slab was largely cracked at the first rolling pass and the subsequent rolling was impossible. |
| 30 | Comparative Example | 520 | 30 | 12000 | Slab was largely cracked at the first rolling pass and the subsequent rolling was impossible. |
| 31 | Comparative Example | 520 | 5 | 1800 | Slab was largely cracked on both edges at the second rolling pass and the subsequent rolling was impossible. |
| 32 | Comparative Example | 510 | 5 | 1250 | Slab was largely cracked on both edges at the third rolling pass and the subsequent rolling was impossible. |

*Alloy Sample No. 4

TABLE 8

| Case No. | Classification | Homogenization Conditions Temp. (°C.) | Homogenization Conditions Time (Hr) | Maximum Grain Diameter (μm) after Homogenization | Results of Hot Rolling |
|---|---|---|---|---|---|
| 33 | Example of the Invention | 480 | 13 | 70 | Good and no crack was generated at all. |
| 34 | Example of the Invention | 490 | 7 | 95 | Good and no crack was generated at all. |
| 35 | Example of | 500 | 2 | 105 | Good and no crack was generated at all. |

TABLE 8-continued

| Case No. | Classification | Homogenization Conditions Temp. (°C.) | Homogenization Conditions Time (Hr) | Maximum Grain Diameter (μm) after Homogenization | Results of Hot Rolling |
|---|---|---|---|---|---|
| | the Invention | | | | |
| 36 | Example of the Invention | 510 | 1 | 115 | Good and no crack was generated at all. |
| 37 | Example of the Invention | 530 | 1 | 245 | No particular problem although fine cracks of about 3 mm in length were generated on both edges. |
| 38 | Comparative Example | 540 | 28 | 24000 | Slab was largely cracked at the first rolling pass and the subsequent rolling was impossible. |
| 39 | Comparative Example | 550 | 1 | 12500 | Slab was largely cracked at the first rolling pass and the subsequent rolling was impossible. |
| 40 | Comparative Example | 520 | 30 | 11500 | Slab was largely cracked at the first rolling pass and the subsequent rolling was impossible. |
| 41 | Comparative Example | 520 | 5 | 1500 | Slab was largely cracked on both edges at the second rolling pass and the subsequent rolling was impossible. |
| 42 | Comparative Example | 510 | 4 | 1150 | Slab was largely cracked on both edges at the third rolling pass and the subsequent rolling was impossible. |

*Alloy Sample No. 15

Thereafter, the resultant alloy slab was subjected to hot rolling under conditions wherein the hot mill entrance temperature was 380° C. and the rolling pass schedule was similar to that of Example 1. Then, the hot workability thereof were compared with one another.

The results thus obtained are shown in Tables 7 and 8. It is apparent from Tables 7 and 8, that sample nos. 23 to 27 and sample nos. 33 to 3, which were homogenized under the homogenization conditions similar to the manufacturing process of the present invention, exhibit superior hot workability.

On the other hand, sample nos. 29 and 39, which were homogenized under extremely high homogenizing temperatures and sample nos. 28, 30, 38 and 40, in which the time for homogenization was substantially long, each sample had a maximum grain diameter which exceeded 1000 μm. This feature generated numerous cracks which appeared during the initial hot rolling, and subsequent hot rolling of these samples was impossible.

Furthermore, in sample nos. 31, 32, 41 and 42, even though the homogenizing conditions can be construed to be within the scope of the process of the present invention, the samples generated numerous cracks during hot rolling, such that they could not be subjected to subsequent rolling. It is seen that each of these samples had a maximum grain diameter which exceeded 1000 μm.

EXAMPLE 3

DC alloy slabs (thickness: 500 mm, width: 1500 mm and length: 5000 ram) from samples nos. 3 (Table 3) and 14 (Table 2) having the compositions according to the example of the present invention were prepared and then homogenized (the maximum grain diameter equaled 105 μm). The respective alloy slabs were homogenized at 480° C. for 2 hrs.

Thereafter, the resultant slab was subjected to hot rolling up to 5 mm in thickness respectively under different conditions (including a hot mill entrance temperature and each reduction per pass), as shown in Tables 9 and 10. Hot workability of each slab was compared with one another.

The results thus obtained are shown in Tables 9 and 10.

TABLE 9

| Case No. | Classification | Hot Mill Entrance Temp. (°C.) | Reduction (%) per Pass 1st Pass | 2nd Pass | 3rd Pass | 4th Pass | 5th Pass | 6th Pass | on and after 7th Pass | Total Pass No. | Result of Hot Rolling |
|---|---|---|---|---|---|---|---|---|---|---|---|
| 43 | Example of the Invention | 335 | 1.0 | 1.1 | 1.5 | 2.5 | 3.5 | 3.8 | Gradually increased 4–40 | 32 | Good and no crack was generated at all. |
| 44 | Example of the Invention | 380 | 1.5 | 1.5 | 2.2 | 3.5 | 4.0 | 4.5 | Gradually increased 5–40 | 28 | Good and no crack was generated at all. |
| 45 | Example of the Invention | 400 | 1.8 | 2.2 | 2.8 | 4.5 | 4.6 | 4.8 | Gradually increased 5–40 | 28 | Good and no crack was generated at all. |
| 46 | Example of the Invention | 445 | 1.2 | 2.4 | 2.0 | 3.0 | 4.0 | 4.0 | Gradually increased 5–45 | 22 | Good and no crack was generated at all. |
| 47 | Example of the Invention | 458 | 1.5 | 1.8 | 2.2 | 4.0 | 4.5 | 5.0 | Gradually increased 5–45 | 21 | Good and no crack was generated at all. |
| 48 | Comparative Example | 480 | 1.8 | 2.5 | 2.5 | — | — | — | — | — | Slab was finely cracked at the second pass and largely cracked at the third pass. |
| 49 | Comparative Example | 495 | 1.5 | — | — | — | — | — | — | — | Slab was largely cracked at the first pass. |
| 50 | Comparative Example | 310 | 0.5 | 0.5 | 0.5 | 0.4 | 0.3 | 0.2 | — | — | Deformation resistance was large, reduction was hard, and the subseqeunt rolling |

TABLE 9-continued

| Case No. | Classification | Hot Mill Entrance Temp. (°C.) | Reduction (%) per Pass 1st Pass | 2nd Pass | 3rd Pass | 4th Pass | 5th Pass | 6th Pass | on and after 7th Pass | Total Pass No. | Result of Hot Rolling |
|---|---|---|---|---|---|---|---|---|---|---|---|
| | | | | | | | | | | | was creased. |
| 51 | Comparative Example | 420 | 4.5 | 5.0 | 5.0 | — | — | — | — | — | Slab was finely cracked at the second pass and largely cracked at the third pass. |
| 52 | Comparative Example | 400 | 4.0 | 4.0 | 4.0 | 5.0 | — | — | — | — | Slab was finely cracked at the third pass and largely cracked at the fourth pass. |

*Alloy Sample No. 3

TABLE 10

| Case No. | Classification | Hot Mill Entrance Temp. (°C.) | Reduction (%) per Pass 1st Pass | 2nd Pass | 3rd Pass | 4th Pass | 5th Pass | 6th Pass | on and after 7th Pass | Total Pass No. | Result of Hot Rolling |
|---|---|---|---|---|---|---|---|---|---|---|---|
| 53 | Example of the Invention | 335 | 1.0 | 1.1 | 1.5 | 2.5 | 3.5 | 3.8 | Gradually increased 4–40 | 32 | Good and no crack was generated at all. |
| 54 | Example of the Invention | 380 | 1.5 | 1.5 | 2.2 | 3.5 | 4.0 | 4.5 | Gradually increased 5–40 | 28 | Good and no crack was generated at all. |
| 55 | Example of the Invention | 400 | 1.8 | 2.2 | 2.8 | 4.5 | 4.6 | 4.8 | Gradually increased 5–40 | 28 | Good and no crack was generated at all. |
| 56 | Example of the Invention | 445 | 1.2 | 2.4 | 2.0 | 3.0 | 4.0 | 4.0 | Gradually increased 5–45 | 22 | Good and no crack was generated at all. |
| 57 | Example of the Invention | 458 | 1.5 | 1.8 | 2.2 | 4.0 | 4.5 | 5.0 | Gradually increased 5–45 | 21 | Good and no crack was generated at all. |
| 58 | Comparative Example | 480 | 1.8 | 2.5 | 2.5 | — | — | — | — | — | Slab was finely cracked at the second pass and largely cracked at the third pass. |
| 59 | Comparative Example | 495 | 1.5 | — | — | — | — | — | — | — | Slab was largely cracked at the first pass. |
| 60 | Comparative Example | 310 | 0.5 | 0.5 | 0.5 | 0.4 | 0.3 | 0.2 | — | — | Deformation resistance was large, reduction was hard, and the subseqeunt rolling was creased. |
| 61 | Comparative Example | 420 | 4.5 | 5.0 | 5.0 | — | — | — | — | — | Slab was finely cracked at the second pass and largely cracked at the third pass. |
| 62 | Comparative Example | 400 | 4.0 | 4.0 | 4.0 | 5.0 | — | — | — | — | Slab was finely cracked at the third pass and largely cracked at the fourth pass. |

*Alloy Sample No. 14

Sample nos. 43 to 47 and sample nos. 53 to 57, which were homogenized under conditions similar to the present invention exhibited superior hot workability.

By contrast, sample nos. 48, 49, 58 and 59, which were hot rolled at a high hot mill entrance temperature generated numerous cracks. Similarly, samples 51, 52, 61 and 62, in which the reduction per pass up to the third rolling pass was substantially high, numerous cracks occurred during the initial stage of hot rolling.

Further, samples 50 and 60, in which the hot mill entrance temperature was low, had a high degree of deformation resistance, such that the reduction was hard to be carried out. As a result, subsequent rolling was not performed.

As described above, high Mg content Al-Mg alloy sheets produced according to present invention, had an elongation factor equal to or superior to cold rolled steel sheets. Additionally, high Mg content Al-Mg alloy sheets of the present invention prevent cracks from appearing during the step of hot rolling thus improving the final yield of the finished product when compared to conventional aluminum alloy sheets.

Having described preferred embodiments of the invention, it is to be understood that the invention is not limited to those precise embodiments, and that various changes and modifications may be effected therein by one skilled in the art without departing from the scope or spirit of the invention as defined in the appended claims.

What is claimed is:

1. A process for manufacturing Al-Mg alloy sheets for press forming, comprising:

preparing an Al-Mg based alloy slab:

homogenizing said alloy slab at a homogenizing temperature from 450° to 540° C., for a period of time to maintain an average grain size of less than 1000 μm;

hot rolling said slab at a hot mill entrance temperature, wherein said step of hot rolling includes multiple passes;

each of said multiple passes producing a reduction of said slab;

said reduction for a first three passes of said multiple passes being not more than 3%;

cold rolling said slab and annealing said slab:

said step of cold rolling and said step of annealing being interchangeable in order, wherein said Al-Mg alloy slab contains by weight, from about 5 to about 10% Mg, from about 0.0001 to about 0.01% Be, from about 0.01 to about 0.2% of at least one of Mn, Cr, V and Zr, from about 0.005 to about 0.1% Ti, of from about 0.00001 to about 0.05% B, with a balance substantially Al and inevitable impurities consisting essentially of Fe, and Si, wherein said impurities being present in amounts less than 0.2%.

2. The process according to claim 1, wherein:

said period of time is less than 24 hours.

3. The process according to claim 1, wherein:

said hot mill entrance temperature ranges from about 320° to about 470° C.

4. The process according to claim 1, wherein said average grain diameter being less than 200 μm.

5. The process according to claim 1, wherein said inevitable impurities further include up to 0.3 wt % Zn.

6. A process for manufacturing Al-Mg alloy sheets for press forming, comprising:

preparing an Al-Mg based alloy slab;

homogenizing said slab at a homogenizing temperature from about 450° to about 540° C. for a period of time to maintain an average grain size of less than 1000 μm;

hot rolling said slab at a hot mill entrance temperature, wherein said step of hot rolling includes multiple passes:

each of said multiple passes producing a reduction of said slab:

said reduction for a first three passes of said multiple passes being not more than 3%:

cold rolling said slab and annealing said slab;

said step of cold rolling and said step of annealing being interchangeable in order, wherein said Al-Mg alloy slab contains by weight, from about 5 to about 10% Mg, from about 0.0001 to about 0.01% Be, from about 0.01 to about 0.2% of at least one of Mn, Cr, V and Zr, from about 0.005 to about 0.1% Ti, from about 0.00001 to about 0.05% B, from about 0.05 to about 0.8% Cu, with a balance substantially Al and inevitable impurities consisting essentially of Fe and Si, wherein said impurities being present in amounts less than 0.2%.

7. The process according to claim 6, wherein:

said period of time is less than 24 hours.

8. The process according to claim 6, wherein:

said hot mill entrance temperature ranges from about 320° to about 470° C.

9. The process according to claim 6, wherein said average grain diameter being less than 200 μm.

10. The process according to claim 6, wherein said inevitable impurities further include up to 0.3 wt % Zn.

* * * * *

UNITED STATES PATENT AND TRADEMARK OFFICE

CERTIFICATE OF CORRECTION

PATENT NO. : 5,423,925

DATED : June 13, 1995

INVENTOR(S) : Ryo SHOJI and Yoichiro BEKKI

It is certified that an error appears in the above-identified patent and that said Letters Patent is hereby corrected as shown below:

Cover Page, Item [73], add --KAWASAKI STEEL CORPORATION, Kobe, Japan--.

Signed and Sealed this

Twenty-first Day of November, 1995

*Attest:*

Bruce Lehman

BRUCE LEHMAN

*Attesting Officer*

*Commissioner of Patents and Trademarks*